US008636467B2

(12) United States Patent
Carter et al.

(10) Patent No.: US 8,636,467 B2
(45) Date of Patent: Jan. 28, 2014

(54) VARIABLE GEOMETRY TURBINE

(75) Inventors: Jeffrey Carter, Mirfield (GB); David Andrew Luck, Huddersfield (GB); Henry David Lambton Carr, Huddersfield (GB); Przemyslaw Swidlinski, Huddersfield (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 720 days.

(21) Appl. No.: 12/990,337

(22) PCT Filed: Mar. 11, 2009

(86) PCT No.: PCT/GB2009/000645
§ 371 (c)(1),
(2), (4) Date: Oct. 29, 2010

(87) PCT Pub. No.: WO2009/133334
PCT Pub. Date: Nov. 5, 2009

(65) Prior Publication Data

US 2011/0038714 A1 Feb. 17, 2011

(30) Foreign Application Priority Data

Apr. 29, 2008 (GB) ..... 0807721.6

(51) Int. Cl.
*F01D 17/16* (2006.01)

(52) U.S. Cl.
USPC ..... 415/158; 415/167

(58) Field of Classification Search
USPC ..... 415/157, 158, 167
See application file for complete search history.

(56) References Cited

U.S. PATENT DOCUMENTS 3,032,259 A 5/1962 Jassniker
4,886,416 A 12/1989 Wunderlich (Continued)

FOREIGN PATENT DOCUMENTS

DE 3244190 A1 10/1983
EP 2 085 576 8/2009

(Continued)

OTHER PUBLICATIONS

International Search Report and Written Opinion, PCT/GB2009/000645, Jun. 29, 2010, Cummins Turbo Technologies Limited.

(Continued)

*Primary Examiner* — Ninh H Nguyen
(74) *Attorney, Agent, or Firm* — Krieg DeVault LLP; Clifford W. Browning

(57) ABSTRACT

A variable geometry turbine of the kind used in a turbocharger has a variable geometry element such as a nozzle ring that is operated by an actuator. The actuator comprises a motor which drives a cross-shaft in rotation. The cross-shaft in turn drives a pair of guide rods on which the nozzle ring is supported in translation so as to move the nozzle ring and control the width of the inlet passage of the turbine. The cross-shaft and guide rods are drivingly engaged by a rack and pinion or thread or another toothed or threaded formation suitable for converting rotational movement into translational movement. The cross-shaft can be located in close proximity to the guide rods and the output of the motor shaft so as to provide a compact package. Moreover, the torque required to resist movement of the nozzle ring in operation is much reduced in comparison to existing designs.

29 Claims, 5 Drawing Sheets

(56) References Cited

U.S. PATENT DOCUMENTS

| | | | | |
|---|---|---|---|---|
| 4,932,835 | A | 6/1990 | Sorokes | |
| 5,044,880 | A * | 9/1991 | McKean | 415/158 |
| 5,214,920 | A * | 6/1993 | Leavesley | 60/602 |
| 5,231,831 | A | 8/1993 | Leavesley | |
| 5,868,552 | A * | 2/1999 | McKean et al. | 415/158 |
| 6,347,921 | B1 | 2/2002 | Watanabe | |
| 2004/0128997 | A1 * | 7/2004 | Parker | 60/602 |

FOREIGN PATENT DOCUMENTS

| | | | |
|---|---|---|---|
| GB | 753 316 | | 7/1956 |
| GB | 2 392 956 | | 3/2004 |
| WO | WO 00/20726 | | 4/2000 |
| WO | WO 2006/097674 | | 9/2006 |
| WO | WO2008148060 | A2 | 11/2008 |
| WO | WO2008149060 | A2 | 11/2008 |

OTHER PUBLICATIONS

United Kingdom Search Report GB0807721.6, Cummins Turbo Technologies Limited, Aug. 5, 2008.

* cited by examiner

VARIABLE GEOMETRY TURBINE

CROSS REFERENCE TO RELATED APPLICATIONS

The present application is a §371 national stage patent application of PCT/GB2009/000645 filed Mar. 11, 2009, which claims priority to United Kingdom Patent Application No. 0807721.6 filed Apr. 29, 2008, each of which is incorporated herein by reference.

The present invention relates a variable geometry turbine and to a turbomachine, such as a turbocharger, incorporating such a turbine.

Turbochargers are well known devices for supplying air to the intake of an internal combustion engine at pressures above atmospheric (boost pressures). A conventional turbocharger essentially comprises an exhaust gas driven turbine wheel mounted on a rotatable shaft within a turbine housing. Rotation of the turbine wheel rotates a compressor wheel mounted on the other end of the shaft within a compressor housing. The compressor wheel delivers compressed air to the engine intake manifold. The turbocharger shaft is conventionally supported by journal and thrust bearings, including appropriate lubricating systems, located within a central bearing housing connected between the turbine and compressor wheel housing.

In known turbochargers, the turbine stage comprises a turbine chamber defined by the turbine housing and within which the turbine wheel is mounted, an annular inlet passageway arranged around the turbine chamber, an inlet arranged around the inlet passageway, and an outlet passageway extending from the turbine chamber. The passageways and chambers communicate such that pressurised exhaust gas admitted to the inlet chamber flows through the inlet passageway to the outlet passageway via the turbine chamber and rotates the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suit varying engine demands.

In one common type of variable geometry turbine, one wall of the inlet passageway is defined by a movable wall member (generally referred to as a "nozzle ring"). The position of the nozzle ring relative to a facing wall (sometimes referred to as the "shroud") of the inlet passageway is adjustable to control the width of the inlet passageway. For instance, as gas flowing through the turbine decreases the inlet passageway width may also be decreased to maintain gas velocity and optimise turbine output. Typically the nozzle ring is provided with vanes, which extend into the inlet passageway and through slots provided on the facing wall of the inlet passageway to accommodate movement of the movable nozzle ring. Alternatively, vanes may extend from a fixed wall through slots provided in the nozzle ring. The nozzle ring is generally supported on rods extending parallel to the axis of rotation of the turbine wheel and is moved by an actuator, which is operable to displace the rods in an axial direction.

Various types of actuators may be used to move the nozzle ring including, for example, a pneumatic actuator or a motor and gear transmission which are generally mounted on the outside of the housing. The actuator is coupled to the nozzle ring by a yoke pivotally supported on a shaft that is journalled in the housing, the yoke defining two spaced apart elongate arms which extend on opposite sides of the turbine axis to engage portions of the support rods extending outside the housing. The end of each arm has a pin that extends into a sliding block that is in turn received in a slot defined in a respective support rod. Operation of the actuator causes the yoke to pivot about the shaft such that the pins on the arms describe an arc of a circle and that in turn causes the blocks to move axially and slide vertically within the slots defined in the support rods. Axial movement of the nozzle ring can thus be achieved by rotation of the yoke about the shaft.

In the variable geometry turbine described above, the yoke pivot is located in the hostile environment outside the housing and cannot be readily lubricated. The engagement of the yoke arms with the rods is of a sliding nature and, although it is known to incorporate wear resistant materials in the sliding surfaces such as, for example, ceramics, those surfaces cannot readily be lubricated. Accordingly wear can be a problem with the known assembly.

When an electric motor is used to actuate the yoke and nozzle ring it is configured to drive the yoke shaft in rotation via a gear transmission. The motor, the gears and a controller are typically mounted on the outside of the bearing housing in a water-cooled module. The full length of travel of the nozzle ring is typically effected by rotating the yoke shaft through about 30°, although with an appropriate gear transmission ratio the motor shaft will make multiple turns to achieve this.

In operation, the aerodynamic flow of exhaust gas through the turbine inlet exerts a significant load on the nozzle ring and this is transmitted via the rods to the ends of yoke arms. If this "back-drive" is not resisted the nozzle ring is forced to the position where the annular inlet passageway is fully open. Since the arms of the yoke are relatively long this in turn imparts a significant torque on the yoke shaft that has to be reacted by the application of continuous torque from the motor in order for the nozzle ring to be maintained in position against the force applied by the gas. The magnitude of the yoke shaft torque for a given force applied to the nozzle ring is proportional to the distance of the ends of the yoke arms from the yoke shaft rotational axis.

It is desirable to improve the torque capacity of the motor without taking up any additional space on the bearing housing. It is also desirable to move the nozzle ring with greater precision.

It is one object of the present invention, amongst others, to obviate or mitigate the aforementioned disadvantages. It is also an object to provide for an alternative or an improved variable geometry turbine.

According to a first aspect of the present invention there is provided a variable geometry turbine comprising a turbine wheel mounted within a housing for rotation about a turbine axis, a gas flow inlet passage upstream of said turbine wheel, and a gas flow control mechanism located upstream of said turbine wheel and operable to control gas flow through said gas flow inlet passage, and an actuator assembly for operating the control mechanism, the control mechanism comprising a movable member for varying the size of the gas flow inlet passage, the movable member being mounted on at least one guide member that is translatable in a direction substantially parallel to the turbine axis, the actuator assembly comprising a rotary drive member and a drive shaft, the rotary drive member being configured to drive the drive shaft in rotation about a drive axis, the drive shaft being transverse to the at least one guide member and arranged to drive the at least one guide member in translation, the drive shaft having at least one first drive formation arranged around its drive axis for engagement with at least one second drive formation on the at least one guide member.

The present invention, by providing for a transverse drive shaft that drives the guide member in translation by virtue of respective engaging first and second drive formations, allows for a very compact arrangement in which the torque required to operate the control mechanism, or to resist back-drive movement of the control mechanism, is significantly lower than that provided by prior art drives.

The at least one first drive formation is arranged around the drive axis of the drive shaft such that during rotation of the drive shaft it continually or repeatedly engages the at least one second drive formation as it moves relative thereto, the at least one first drive formation rotating about the drive axis.

The at least one first drive formation may extend partially or wholly around the drive axis. It may be provided by a gear.

The at least one first drive formation may extend in a substantially circumferential direction around the drive axis of the drive shaft. It may also extend in a direction along the drive axis of the drive shaft. It may be defined on a peripheral portion of the drive shaft. The arrangement of the at least one drive formation in this manner provides for a compact arrangement of the drive and a robust, durable mechanism.

The at least one first drive formation may be a toothed gear wheel and the at least one second drive formation may be a toothed rack so that rotation of the drive shaft and therefore the gear wheel causes translation of the toothed rack and therefore the at least one guide member. The toothed gear wheel may a pinion fixed or integrally formed on the drive shaft for rotation therewith.

The toothed rack may be supported on the at least one guide member. It may be integrally formed or a discrete component. The toothed rack may be rotatably supported on the at least one guide member, preferably at or adjacent to one end, but not necessarily so. It may be defined on the outer surface of a member. The member may have a generally cylindrical inner surface that is rotatably supported on a surface of the at least one guide member.

In an alternative embodiment the at least one first drive formation and the at least one second drive formation combine to form a worm drive. The at least one first drive formation may be a worm gear thread arranged circumferentially and axially around the drive shaft axis and the at least one second drive formation has a peripheral toothed formation such that rotation of the worm gear thread effects rotation or translational movement of the at least one second drive formation.

The toothed formation may be defined on a surface of the at least one guide member or it may be defined on a member connected to or supported on the at least one guide member.

The toothed formation may comprise an array of teeth spaced along at least part of the length of the at least one guide member or it may comprise an array of teeth defined on rotary member supported on the at least one guide member. In the latter case the rotary member may be a nut that is threadedly engaged with a threaded formation on the guide member, the toothed formation being defined on an outer surface of the nut, arranged around an axis of the nut. The nut may be fixed against axial movement such that rotation of the rotary member effects translation of the at least one guide member. A resilient member may be provided to absorb back drive including pulse forces applied by gas to the at least one guide member via the control mechanism. The resilient member may be in the form of a spring washer. The washer may be situated adjacent to a circumferential array of ball bearings.

The drive shaft may be supported at each end in the housing by bearings such as, for example, journal and axial thrust bearings. The housing may comprise a first portion in which the turbine wheel is received and a second portion in which a shaft of the turbine wheel is supported in bearings. The drive shaft may be supported in the second portion of the housing.

The rotary drive member may be a motor having an output shaft which drives the drive shaft via a worm gear. Alternatively the output shaft of the motor may form the drive shaft or may be drivingly coupled to the drive shaft either directly or through a gear transmission.

The output shaft of the motor may extend into the housing and may be disposed between the drive shaft and the movable member. The axis of the output shaft of the motor may be closer to the axis of the drive shaft than it is to the movable member so as to provide a compact arrangement.

The output shaft of the motor may be substantially perpendicular to drive shaft.

The at least one guide member may be a guide rod arranged for axial translation along its length. In one embodiment there are a pair of such guide rods that may be arranged on each side of the turbine axis. The motor output shaft is preferably disposed between the guide rods. The guide rods each have a translational axis and the axis of the motor shaft and the drive shaft are disposed in close proximity thereto to allow for a compact arrangement in which the torque required from the motor to resist the force applied to the movable member is relatively low compared to prior art arrangements.

There may be provide a pair of guide members and the drive shaft may have a pair of first drive formations defined at spaced locations along its length for engagement with a respective second drive formation on the pair of guide members.

The movable member may be a substantially annular wall member which may have a central axis arranged to be substantially coaxial with the axis of the turbine.

The movable member may be disposed opposite a facing wall of the housing, the distance between the movable member and the facing wall determining the size of the gas flow inlet passage.

The substantially annular wall member may support an array of vanes that extend in a direction away from the at least one guide member in a direction substantially parallel to the axis of the turbine.

In accordance with another aspect of the present invention there is provided a turbomachine, such as a turbocharger, comprising a variable geometry turbine as defined above and a compressor driven by said turbine.

The turbine wheel may be rotatable on a turbine shaft and the housing may comprise a turbine housing portion in which the turbine wheel is housed and a bearing housing portion in which bearings for the turbine shaft of the turbine are housed. The drive shaft of the actuator assembly may be received in the bearing housing. The output shaft of the rotary drive member motor may extend into the bearing housing.

Specific embodiments of the present invention will now be described, by way of example only, with reference to the accompanying drawings, in which.

Figure 1:
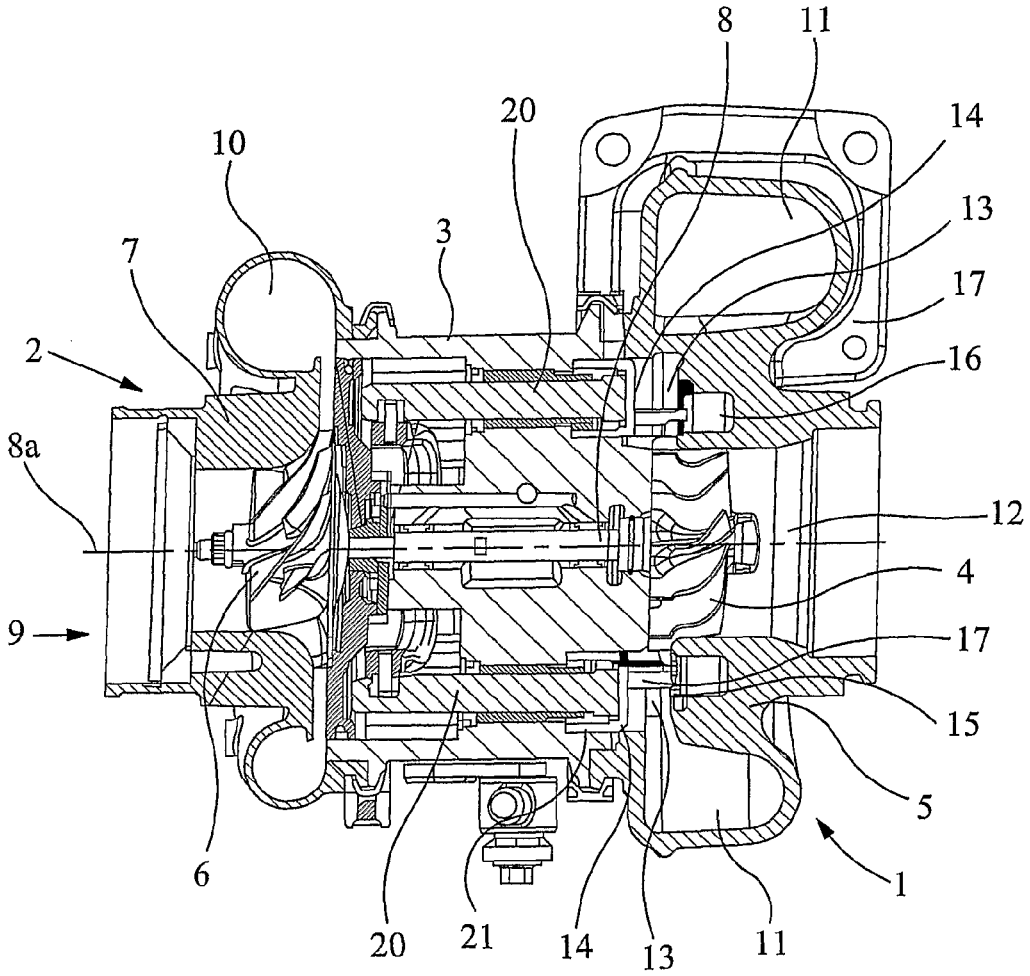
FIG. 1 is a longitudinal sectioned view through a turbocharger fitted with a variable geometry turbine in accordance with the present invention.

Referring to FIG. 1, the illustrated turbocharger comprises a turbine 1 joined to a compressor 2 via a central bearing housing 3. The turbine 1 comprises a turbine wheel 4 rotating within a turbine housing 5. Similarly, the compressor 2 comprises a compressor wheel 6 that rotates within a compressor housing 7. The turbine wheel 4 and compressor wheel 6 are mounted on opposite ends of a common turbocharger shaft 8 that extends through the central bearing housing 3.

As is conventional, the bearing housing 3 has a central portion which houses journal bearing assemblies located towards the compressor and turbine ends of the bearing housing respectively.

In use, the turbine wheel 4 is rotated about axis 8*a* by the passage of exhaust gas passing over it from the internal combustion engine. This in turn rotates the compressor wheel 6 that draws intake air through a compressor inlet 9 and delivers boost air to the inlet manifold of an internal combustion engine via an outlet volute 10.

The turbine housing 5 defines an inlet chamber 11 (typically a volute) to which the exhaust gas from an internal combustion engine is delivered. The exhaust gas flows from the inlet chamber 11 to an axially extending outlet passageway 12 via an annular inlet passageway 13 and turbine wheel 4. The inlet passageway 13 is defined on one side by the face of a radial wall of a movable annular wall member 14, commonly referred to as a "nozzle ring", and on the opposite side by an annular shroud plate 15 that forms the wall of the inlet passageway 13 facing the nozzle ring 14. The shroud plate 15 covers the opening of an annular recess 16 in the turbine housing 5.

The nozzle ring 14 supports an array of circumferentially and equally spaced inlet vanes 17 each of which extends axially across the inlet passageway 13. The vanes 17 are orientated to deflect gas flowing through the inlet passageway towards the direction of rotation of the turbine wheel 4. When the nozzle ring 14 is proximate to the annular shroud plate 15, the vanes 17 project through suitably configured slots in the shroud plate, into the recess 16. The vanes 17 seal against the edges defining the slots so as to prevent any significant flow of gas into the recess 16 when the nozzle ring 14 is proximate the shroud plate 15.

The speed of rotation the turbine wheel 4 is dependent upon the velocity of the gas passing through the annular inlet passageway 13. For a fixed rate of mass of gas flowing into the inlet passageway, the gas velocity is a function of the gap between the nozzle ring 14 and the shroud 15 that defines the passageway 13 and is adjustable by controlling the axial position of the nozzle ring 14 (as the inlet passageway 13 gap is reduced, the velocity of the gas passing through it increases).

The nozzle ring 14 is movable in an axial direction on a pair of diametrically opposed guide rods 20 that extend in the bearing housing 3 in a direction that is substantially parallel to that of the turbocharger shaft 8 and are arranged to translate in that direction. The nozzle ring 14 is mounted on the ends of the rods 20 and, when it is axially disposed such that the gap is at its maximum, it is received in a cavity 21 defined in an end of the bearing housing 3.

Figure 2:
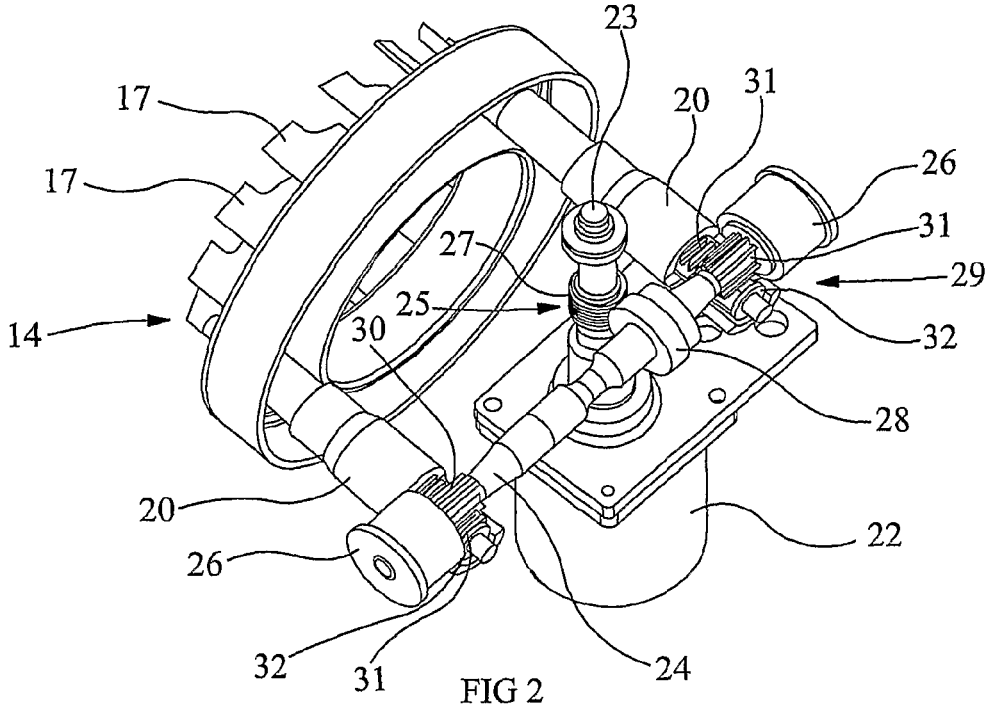
FIG. 2 is a perspective view of a nozzle ring and drive mechanism of a variable geometry turbine in accordance with the present invention, depicted without the bearing housing or turbine housing shown for clarity.
Figure 3:
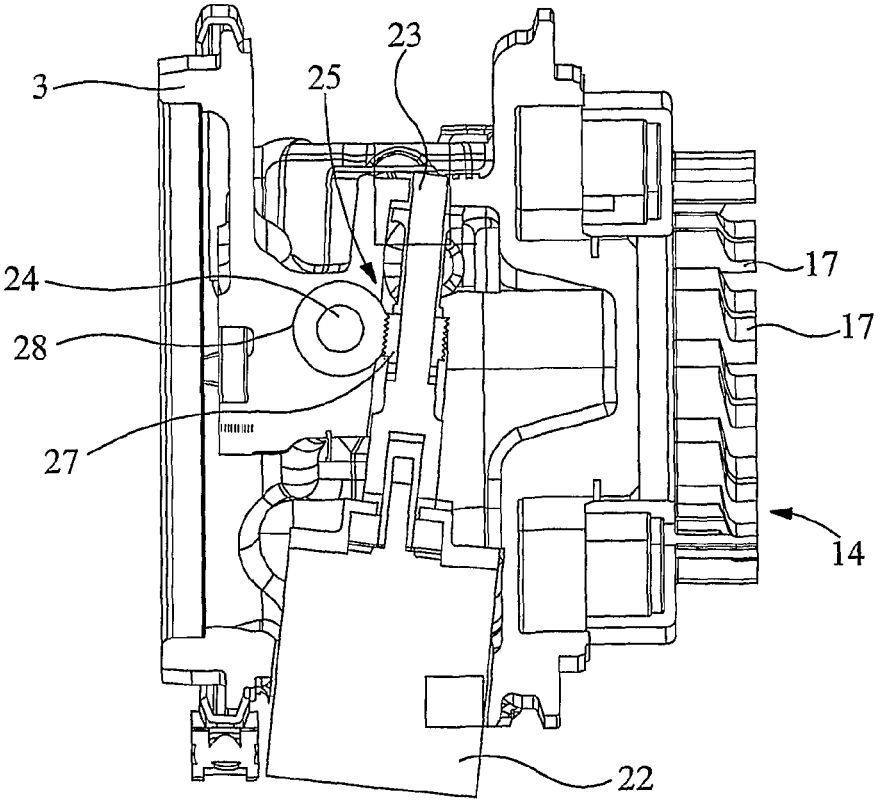
FIG. 3 is a longitudinal sectioned view through an alternative bearing housing fitted with the nozzle ring and drive mechanism of FIG. 2.
Figure 4:
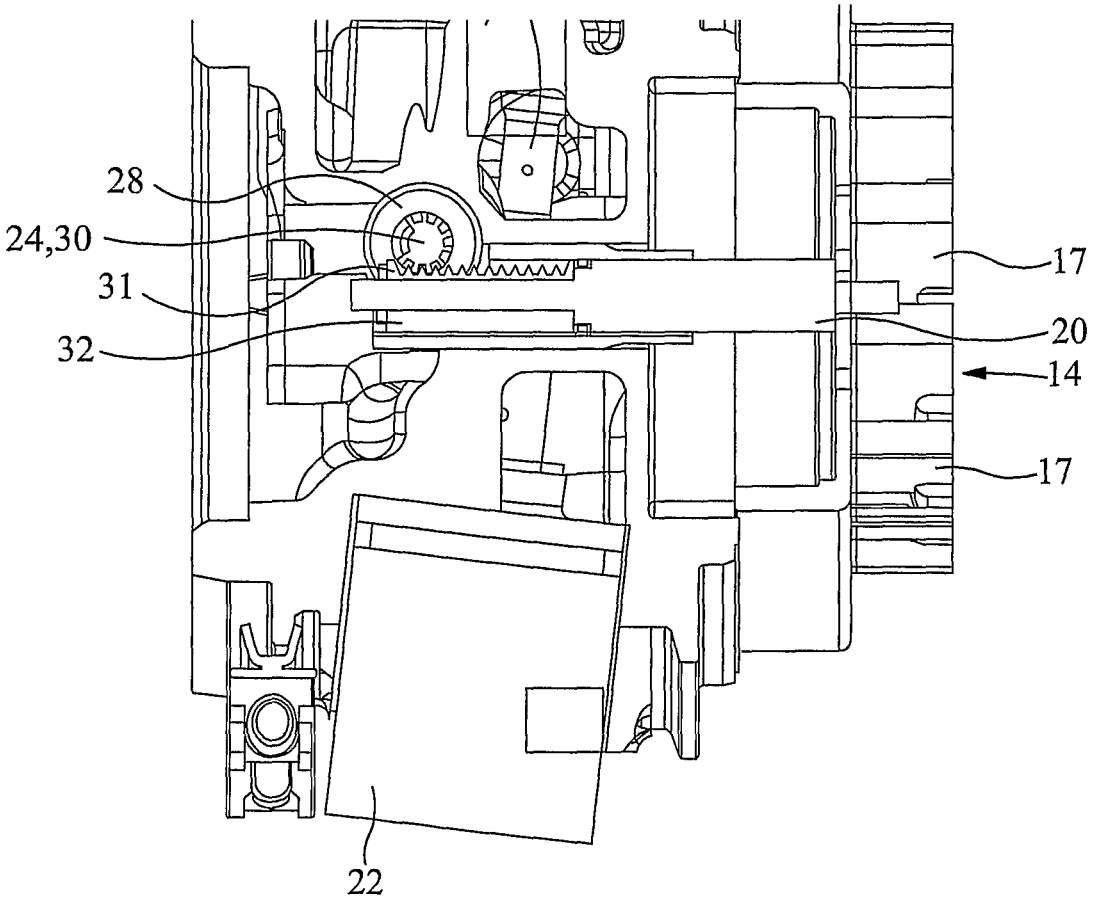
FIG. 4 is a longitudinal section view of the arrangement of FIG. 3 taken in a plane intersecting a guide rod of the drive mechanism.
Figure 5:
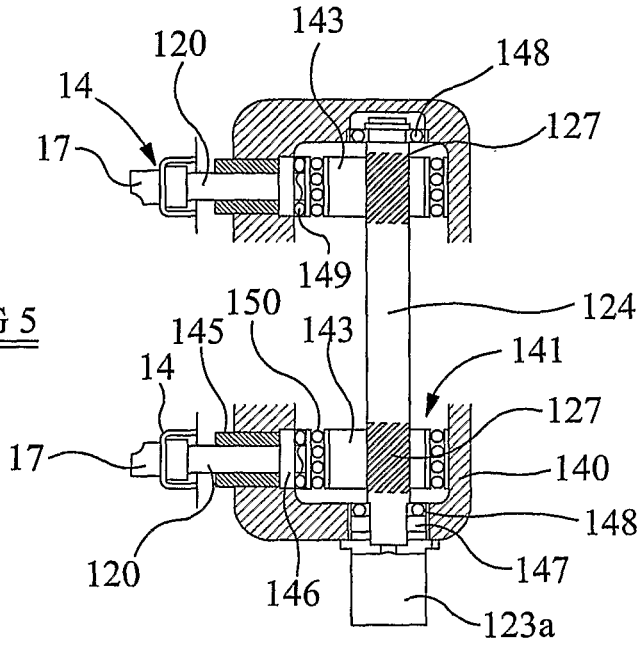
FIG. 5 is a schematic sectioned representation of an alternative drive mechanism for the nozzle ring of the turbocharger of FIG. 1.
Figure 6:
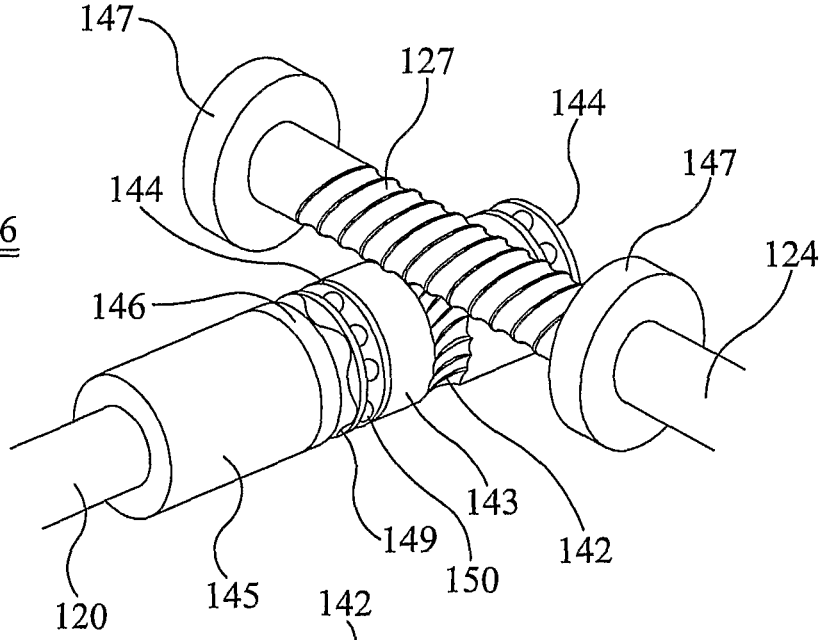
FIG. 6 is a perspective view of part of the mechanism of FIG. 5.
Figure 7:
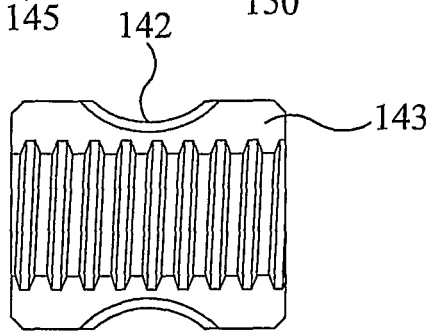
FIG. 7 is a sectioned view of a nut forming part of the mechanism of FIG. 5.
Figure 8:
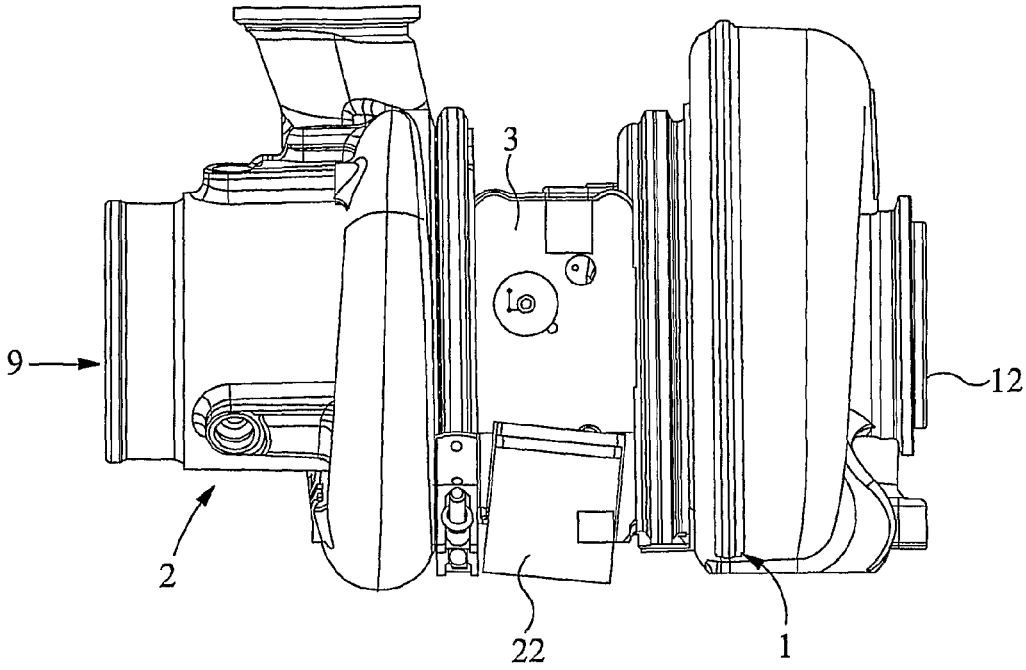
FIG. 8 is an external side view of a turbocharger fitted with the nozzle ring drive mechanism of FIGS. 2 to 4 or FIGS. 5 to 8.

The drive mechanism for driving the guide rods 20 and the nozzle ring 14 in translation is not shown in FIG. 1 in the interests of clarity. One example of such a mechanism is depicted in FIGS. 2 to 4 and is now described in combination with FIGS. 1 and 8. The nozzle ring 14 and rods 20 are coupled to an electric stepper motor 22 for axial positioning. The motor 22 has a rotary output shaft 23 that extends into the bearing housing 3 where it drives a transverse cross-shaft 24 via a worm drive 25. The cross-shaft 24 is rotatably supported at each end in the bearing housing by journal and thrust bearings 26 and has a longitudinal axis that extends in a direction that is substantially perpendicular to the axis 8*a* of the turbocharger shaft 8. The worm drive 25 consists of a worm 27 fixed to the motor shaft 23 and drivingly engaged with a worm gearwheel 28 fixed on the cross-shaft 24.

Rotation of the cross-shaft 24 by the motor 22 is converted into translation of the rods 20, and therefore the nozzle ring 14, by means of a rack and pinion transmission 29 formed at an interface between each of the rods 20 and a respective part of the cross-shaft 24. Two pinions 30 are fixed to or integrally defined on the cross-shaft 24 adjacent a respective shaft bearing 26. Each pinion 30 engages with a respective toothed rack 31 that is supported on the end of a respective one of the rods 20. Rotation of the motor 22 and therefore the cross-shaft 24 is thus converted into translation of the rods 20 so as to effect axial positioning of the nozzle ring 14. The racks 31 are each defined on an upper surface of a respective cylindrical barrel 32 that is rotatably supported on the end of a respective rod 20 at an end remote from the nozzle ring 14. In operation, the ability of the racks 31 to rotate relative to the respective rod 20 is important to accommodate thermal expansion or contraction of the nozzle ring 14 without impairing the driving engagement between the rack and pinion 31, 30. As the nozzle ring 14 expands or contracts the rods 20 tend to rotate about their own axes by small amounts. As the rods 20 can rotate within the barrels 32 this movement or force is not transmitted to the racks 31.

The diameter of the pinions 30 is determined by the distance between the turbocharger shaft 8 and the cross-shaft 24 and this is made as small as possible without risk of interference between the two shafts. The relatively small diameter of the pinions 30 means that the torque applied to the cross-shaft 24 is considerably reduced in comparison to the prior art yoke shaft. Thus for a given aerodynamic load applied to the nozzle ring 14 by the exhaust gas the torque that has to be resisted by the actuator is significantly reduced. The lighter load applied to the drive components (including the motor itself) means that they can be made smaller and are subject to less wear.

The arrangement is compact with the axis of the cross-shaft 20 being located in close proximity to the axis of the output shaft 23 of the motor 22 and the translational axes of the guide rods 20.

In operation, the motor 22 is controlled to rotate the cross-shaft 24 through small angular distances so as to adjust the desired axial position of the nozzle ring 14 and rods 20. The resolution of the stepper motor 22 is designed for accurate axial positioning of the nozzle ring 14 taking into account the gear transmission ratio.

The drive mechanism allows the motor 22 to be positioned toward the bottom of the bearing housing 3 of the turbocharger where space is traditionally available to accommodate the oil drain pipe and also such that it does not extend outwardly from the bearing housing 3 by a significant amount. Its position also allows for it to be replaced easily without the need to remove the drive mechanism. The motor output shaft 23 is disposed between the cross-shaft 24 and the nozzle ring 14 and between the guide rods 20, thereby providing a compact arrangement.

All of the gears in the drive mechanism may be received in oil chambers for better durability.

The worm drive 25 between the motor shaft 23 and the cross-shaft 24 may be adapted to accommodate other gear wheels as necessary. In particular the gears may be designed to prevent back-drive of the nozzle ring 14 so as to reduce the motor power consumption. Smaller motors can thus be employed in comparison to the prior art mechanisms.

An alternative drive mechanism for the nozzle ring is shown in FIGS. 5 to 8. In this design the cross shaft 124 which, in this embodiment, is effectively an extension shaft coupled coaxially to the motor shaft by coupling 123*a*, is supported for rotation in a housing 140 (which may be part of the bearing housing of the turbocharger) as before and is drivingly coupled to the rods 120 by means of an adapted worm drive arrangement 141. A pair of spaced worm threads 127 is defined on the motor shaft 123, each being designed to drive a worm gear 142 defined on an outer surface of an internally threaded nut 143 that is supported on one end of a respective rod 120. The nut 143 is restrained against axial movement by the housing 140 and therefore its rotation is converted into linear movement of the rod 120. Each end of the nut 143 is supported in the housing by bearings 144 and the rods 120 are each supported in the wall of the housing 140 by means of a bearing bush 145. Oil seals 146 are provided between the nut bearings 144 and the bushes 145 so as to prevent leakage of oil from the housing. Similarly, oil seals 147 are disposed adjacent to bearings 148 at each end of the cross shaft 124. A wave spring washer 149 and a circumferential array of ball bearings 150 are disposed between each oil seal 146 and nut and serve to reduce backlash in the system and to absorb exhaust gas pulses applied to the nozzle ring.

The nut and thread arrangement of the drive mechanism of FIGS. 5 to 8 has a significant contact area between the guide rods 120 and respective nut so as to provide a good quality drive. The nuts may be manufactured from a cost-effective sintered metal process.

Figure 9:
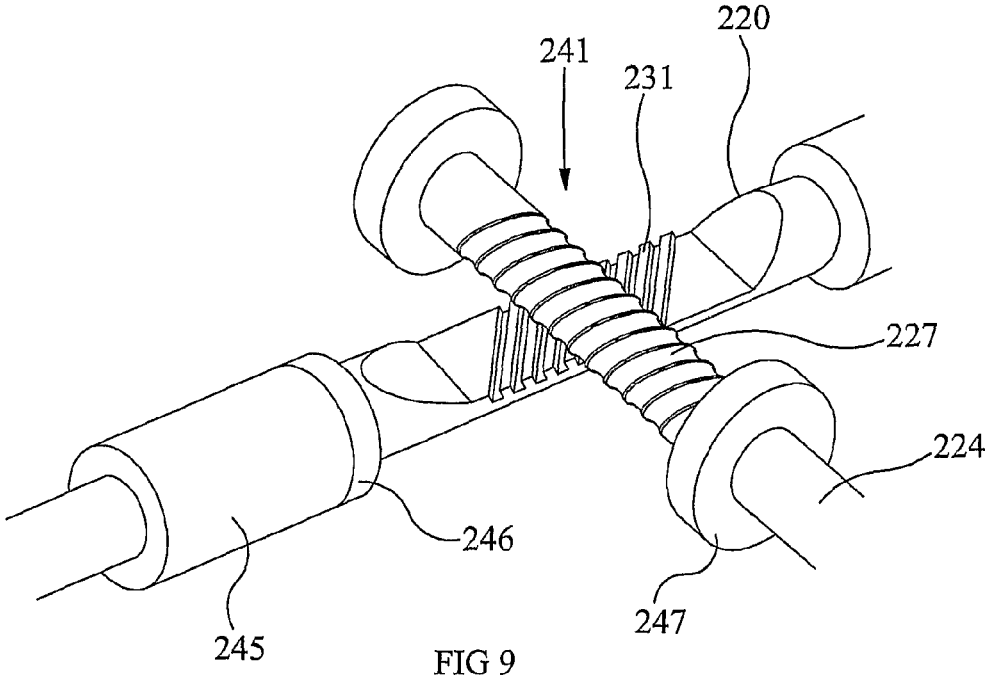
FIG. 9 is a perspective view of part of an alternative drive mechanism for the nozzle ring.

An alternative worm drive 241 between the cross-shaft 224 and each of the rods 220 is shown in FIG. 9. Parts corresponding to those of FIGS. 5 to 8 have been given the same reference numerals but increased by 100. Here the worm 227 is again defined on the cross shaft 224 (which may effectively be an extension of the motor shaft) and is in direct driving engagement with the rods 220 by virtue of a linear toothed rack 231 defined on a flattened region of the rod 220.

In all embodiments the drive mechanism is more durable and offers greater precision and control in the axial positioning of the nozzle ring.

Numerous modifications and variations to the embodiment described above may be made without departing from the scope of the invention as defined in the appended claims. For example, the motor may be drivingly connected to one end of the cross-shaft detail via a suitable gear transmission. Moreover, the variable geometry mechanism, including the nozzle ring, may vary from that shown provided that a movable wall portion is driven directly or indirectly by the drive mechanisms described above. In one example, the positions of nozzle ring (with vanes fixed thereto) and shroud plate may be interchanged with the nozzle ring being fixed and the shroud plate being movable by the drive mechanism.

While the invention has been illustrated and described in detail in the drawings and foregoing description, the same is to be considered as illustrative and not restrictive in character, it being understood that only the preferred embodiments have been shown and described and that all changes and modifications that come within the scope of the inventions as defined in the claims are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. A variable geometry turbine comprising a turbine wheel mounted within a housing for rotation about a turbine axis, a gas flow inlet passage upstream of said turbine wheel, and a gas flow control mechanism located upstream of said turbine wheel and operable to control gas flow through said gas flow inlet passage, and an actuator assembly for operating the control mechanism, the control mechanism comprising a movable member for varying the size of the gas flow inlet passage, the movable member being mounted on at least one guide member that is translatable in a direction substantially parallel to the turbine axis, the actuator assembly comprising a rotary drive member and a drive shaft, the rotary drive member being configured to drive the drive shaft in rotation about a drive axis, the drive shaft being transverse to the at least one guide member and arranged to drive the at least one guide member in translation, the drive shaft having at least one first drive formation arranged around its drive axis for engagement with at least one second drive formation on the at least one guide member.

2. A variable geometry turbine according to claim 1, wherein the at least one first drive formation extends in a substantially circumferential direction around the drive axis of the drive shaft.

3. A variable geometry turbine according to claim 2, wherein the at least one first drive formation is a toothed gear wheel and the at least one second drive formation is a toothed rack.

4. A variable geometry drive formation according to claim 3, wherein the tooth gear wheel is a pinion fixed on the drive shaft.

5. A variable geometry turbine according to claim 3, wherein the toothed rack is supported on the at least one guide member.

6. A variable geometry turbine according to claim 5, wherein the toothed rack is rotatably supported on the at least one guide member.

7. A variable geometry turbine according to claim 6, wherein the toothed rack is defined on a generally cylindrical member rotatably supported on the at least one guide member.

8. A variable geometry turbine according to claim 5, wherein the toothed rack is supported on an end of the at least one guide member.

9. A variable geometry turbine according to claim 2, wherein the at least one first drive formation and the at least one second drive formation form a worm drive.

10. A variable geometry turbine according to claim 9, wherein the at least one first drive formation is a worm thread arranged circumferentially and axially around the drive shaft and the at least one second drive formation is a toothed formation.

11. A variable geometry turbine according to claim 10, wherein the toothed formation is defined on a surface of the at least one guide member.

12. A variable geometry turbine according to claim 11, wherein the toothed formation comprises an array of teeth spaced along at least part of the length of the at least one guide member.

13. A variable geometry turbine according to claim 10, wherein the toothed formation is defined on rotary member rotatably supported on the at least one guide member.

14. A variable geometry turbine according to claim 13, wherein the rotary member is a nut that is threadedly engaged with a threaded formation on the guide member, the toothed formation being defined on an outer surface of the nut.

15. A variable geometry turbine according to claim 14, wherein the nut is fixed against axial movement such that rotation of the rotary member effects translation of the at least one guide member.

16. A variable geometry turbine according to claim 1, wherein the drive shaft is supported at each in the housing by bearings.

17. A variable geometry turbine according to claim 16, wherein the housing comprises a first portion in which the turbine wheel is received and a second portion in which a shaft of the turbine wheel is supported in bearings.

18. A variable geometry turbine according to claim 1, wherein the rotary drive member is a motor having an output shaft which drives the drive shaft via a worm gear.

19. A variable geometry turbine according to claim 18, wherein the output shaft of the motor is perpendicular to drive shaft.

20. A variable geometry turbine according to claim 1, wherein the rotary drive member is a motor having an output shaft that extends into the housing.

21. A variable geometry turbine according to claim 1, wherein the rotary drive member is a motor having an output shaft that is disposed between the drive shaft and the movable member.

22. A variable geometry turbine according to claim 21, wherein the axis of the output shaft of the motor is closer to the axis of the drive shaft than it is to the movable member.

23. A variable geometry turbine according to claim 1, wherein the at least one guide member is a guide rod.

24. A variable geometry turbine according to claim 1, wherein there is provided a pair of guide members and the drive shaft has a pair of first drive formations defined at spaced locations along its length for engagement with respective second drive formation on the pair of guide members.

25. A variable geometry turbine according to claim 1, wherein the movable member is a substantially annular wall member.

26. A variable geometry turbine according to claim 1, wherein the movable member is disposed opposite a facing wall of the housing, the distance between the movable member and the facing wall determining the size of the gas flow inlet passage.

27. A variable geometry turbine according to claim 26, wherein the substantially annular wall member supports an array of vanes that extend in a direction away from the at least one guide member.

28. A variable geometry turbine according to claim 1 in which the housing comprises a turbine housing in which the turbine wheel is housed for rotation on a turbine shaft and a bearing housing in which bearings for supporting rotation of the turbine shaft are housed, the drive shaft being received in the bearing housing.

29. A turbocharger comprising a variable geometry turbine and a compressor driven by the variable geometry turbine; the variable geometry turbine comprising a turbine wheel mounted within a housing for rotation about a turbine axis, a gas flow inlet passage upstream of said turbine wheel, and a gas flow control mechanism located upstream of said turbine wheel and operable to control gas flow through said gas flow inlet passage, and an actuator assembly for operating the control mechanism, the control mechanism comprising a movable member for varying the size of the gas flow inlet passage, the movable member being mounted on at least one guide member that is translatable in a direction substantially parallel to the turbine axis, the actuator assembly comprising a rotary drive member and a drive shaft, the rotary drive member being configured to drive the drive shaft in rotation about a drive axis, the drive shaft being transverse to the at least one guide member and arranged to drive the at least one guide member in translation, the drive shaft having at least one first drive formation arranged around its drive axis for engagement with at least one second drive formation on the at least one guide member.

* * * * *